US006619527B1

(12) United States Patent
Moeller

(10) Patent No.: US 6,619,527 B1
(45) Date of Patent: Sep. 16, 2003

(54) COMBUSTION POWERED TOOL SUSPENSION FOR IRON CORE FAN MOTOR

(75) Inventor: Larry Moeller, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 31 days.

(21) Appl. No.: 09/685,882

(22) Filed: Oct. 10, 2000

(51) Int. Cl.[7] ..... B25C 1/08
(52) U.S. Cl. ..... 227/10; 227/150; 173/210
(58) Field of Search ..... 227/130, 10; 173/210, 173/211; 123/46 SC

(56) References Cited

U.S. PATENT DOCUMENTS

| | | | | |
|---|---|---|---|---|
| 2,953,117 A | | 9/1960 | Wandel et al. | |
| 3,968,843 A | | 7/1976 | Shotwell | |
| 4,403,722 A | | 9/1983 | Nikolich | |
| 4,483,473 A | | 11/1984 | Wagdy | |
| 4,483,474 A | | 11/1984 | Nikolich | |
| 4,522,162 A | | 6/1985 | Nikolich | |
| 4,597,453 A | * | 7/1986 | Kilmer et al. | 140/122 |
| 4,625,903 A | * | 12/1986 | Becht | 173/13 |
| RE32,452 E | | 7/1987 | Nikolich | |
| 4,772,042 A | | 9/1988 | Jinsheng | |
| 4,974,819 A | * | 12/1990 | Reichard et al. | 188/312 |
| 5,170,851 A | * | 12/1992 | Kress et al. | 173/29 |
| 5,177,915 A | * | 1/1993 | Kobori et al. | 248/548 |
| 5,187,400 A | * | 2/1993 | Kurata | 310/49 R |
| 5,197,646 A | | 3/1993 | Nikolich | |
| 5,263,439 A | | 11/1993 | Doherty et al. | |
| 5,320,268 A | | 6/1994 | Shkolnikov et al. | |
| 5,530,304 A | * | 6/1996 | Mirumachi et al. | 310/51 |
| 5,651,419 A | * | 7/1997 | Holzer et al. | 173/183 |
| 5,680,980 A | | 10/1997 | Robinson | |
| 5,687,898 A | | 11/1997 | Toulouse | |
| 5,713,313 A | | 2/1998 | Berry | |
| 5,875,562 A | * | 3/1999 | Fogarty | 34/97 |
| 5,952,766 A | * | 9/1999 | Mukohjima et al. | 310/323.02 |
| 6,045,112 A | * | 4/2000 | Kirkwood | 248/634 |
| 6,171,079 B1 | * | 1/2001 | Gross et al. | 415/119 |
| 6,236,126 B1 | * | 5/2001 | Yagi et al. | 310/261 |
| 6,262,504 B1 | * | 7/2001 | Bartlett | 310/58 |
| 6,269,888 B1 | * | 8/2001 | Schuda et al. | 173/205 |
| 6,375,171 B1 | * | 4/2002 | Zimmermann et al. | 267/137 |
| 6,394,191 B1 | * | 5/2002 | Nakane | 173/217 |

FOREIGN PATENT DOCUMENTS

EP 0 925 880 A2 * 12/1998 ..... B25C/1/08

* cited by examiner

*Primary Examiner*—Stephen F. Gerrity
*Assistant Examiner*—Gloria R Weeks
(74) *Attorney, Agent, or Firm*—Lisa M. Soltis; Mark W. Croll; Donald J. Breh

(57) ABSTRACT

A suspension mechanism for a motor of a combustion chamber fan in a combustion powered hand tool constructed and arranged for driving a driver blade to drive a fastener into a work piece, the tool generating an upward axial acceleration of the motor upon a combustion in the chamber, a subsequent reciprocal axial acceleration of the motor when the piston bottoms out on a bumper, at least one of the accelerations causing the motor to oscillate relative to the tool, the suspension mechanism includes a suspending portion configured for providing progressive dampening to the motor upon the generation of the axial accelerations.

21 Claims, 5 Drawing Sheets

10
12
14
16
18
20
22
26
28
30
32
34
36
40
41
43
50
130
132
136
138
144
146
148
150
152
154
156
158
160
162
164

COMBUSTION POWERED TOOL SUSPENSION FOR IRON CORE FAN MOTOR

RELATED APPLICATION

The present application is related to copending U.S. patent application Ser. No. 08/996,284, filed Dec. 22, 1997 for "Combustion Powered Tool with Improved Combustion Chamber Fan Motor Suspension", which is incorporated by reference herein.

BACKGROUND OF THE INVENTION

The present invention relates generally to improvements in portable combustion powered fastener driving tools, particularly to improvements relating to the suspension of a motor for a combustion chamber fan for decreasing the operationally-induced axial acceleration and oscillation of the motor to decrease wear and tear on the motor, and specifically in applications where low-cost, iron core fan motors are employed to power the combustion chamber fan motor.

Portable combustion powered, or so-called IMPULSE® brand tools for use in driving fasteners into workpieces are described in commonly assigned patents to Nikolich U.S. Pat. Re. No. 32,452, and U.S. Pat. Nos. 4,522,162; 4,483,473; 4,483,474; 4,403,722, 5,197,646 and 5,263,439, all of which are incorporated by reference herein. Similar combustion powered nail and staple driving tools are available commercially from ITW-Paslode of Vernon Hills, Ill. under the IMPULSE® brand.

Such tools incorporate a generally pistol-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position, through differential gas pressures within the cylinder. Fasteners are fed magazine-style into the nosepiece, where they are held in a properly positioned orientation for receiving the impact of the driver blade.

Upon ignition of the combustible fuel/air mixture, the combustion in the chamber causes the acceleration of the piston/driver blade assembly and the penetration of the fastener into the workpiece if the fastener is present. This combined downward movement causes a reactive force or recoil of the tool body. Hence, the fan motor, which is suspended in the tool body, is subjected to an acceleration opposite the power stroke of the piston/driver blade and fastener.

Then, within milliseconds, the momentum of the piston/driver blade assembly is stopped by the bumper at the opposite end of the cylinder and the tool body is accelerated toward the workpiece. Therefore, the motor and shaft are subjected to an acceleration force which is opposite the direction of the first acceleration. These reciprocal accelerations cause the motor to oscillate with respect to the tool. The magnitude of the accelerations, if left unmanaged, are detrimental to the life and reliability of the motor.

Conventional combustion powered tools of the IMPULSE® type require specially designed motors to withstand these reciprocal accelerations of the shaft and motor, and the resulting motor oscillations. Among other things, the motors are preferably of the ironless core type, and are equipped with internal shock absorbing bushings, thrust and wear surfaces, and overall heavier duty construction. Such custom modifications result in relatively expensive motors which increase the production cost of the tools.

Thus, there is a need for a motor suspension mechanism for a combustion powered tool which reduces operating demands on the motor, increases reliability of the motor, and allows the use of closer to standard production fan motors to reduce the tool's production cost. In an ongoing attempt to reduce manufacturing costs, it is desirable to use the lowest cost fan motor possible for this application. At this time, such a motor is a conventional iron core motor, also known as permanent magnet, brushed DC motor of the type produced by Canon and Nidec Copal of Japan, as well as many other known motor manufacturers. When iron core motors were employed as combustion tool fan motors, the conventional suspension was found to result in an underdampened condition, wherein the motor oscillated excessively and out of tune relative to the operational oscillation of the combustion tool, as described above. In other words, there is a mechanical impedance mismatch between the combustion tool and the combustion chamber fan motor. This is due in large part to the greatly reduced weight of the iron core motors as compared to conventional motors. The iron core motors weigh only about ⅓ as much as conventional ironless core combustion chamber fan motors. The iron core motors are less durable, and are incapable of withstanding the degree of 50 g forces or higher which are generated through combustion.

As a result, in operation, the conventional combustion tool motor suspensions underdampen the iron core motor. This underdampening significantly reduces the effectiveness of the suspension, and subjects the motor to damaging axial forces. Instead, the goal is to achieve critical dampening, in which there is just enough dampening to receive the combustion-generated motion and prevent oscillation past equilibrium.

One way to achieve critical dampening between the fan motor and the combustion tool is to increase its flexibility, as by reducing the mass of the resilient suspension member which circumscribes and projects radially from the motor and the motor container to fasten those components to the combustion head of the tool. It has been found that increasing the flexibility in this way, to a degree which will satisfactorily suspend the iron core motor, also results in the unsatisfactory situation wherein the suspension member loses its resiliency and, upon the generation of the forces initiated by combustion, is unable to return the motor to the designated start position.

Another design parameter of combustion tools is that, while capacitors are known for reducing voltage spikes and transients for brushed motors, and it is advantageous to place the capacitor closer to the source of the spikes and transients, capacitors were not able to survive the impact forces generated in a combustion tool at the fan motor. Thus, such noise suppression capacitors had to be mounted in more remote, and less effective locations on the tool.

Thus, there is a need for a combustion tool fan motor suspension which can accommodate an iron core motor and provide sufficient dampening to protect the motor from combustion-generated impact forces. There is also a need for a combustion tool fan motor suspension which allows the mounting of a noise suppression capacitor on or near the fan motor.

Accordingly, it is an object of the present invention to provide an improved combustion powered tool with an improved suspension mechanism for an iron core combustion chamber fan motor, in which the suspension reduces operationally-induced reciprocal accelerations of the motor while keeping the oscillations of the motor within an acceptable range.

Another object of the present invention is to provide an improved combustion powered tool which features a mechanism for dampening operationally-induced oscillation of the combustion chamber fan motor, especially when the motor is of the iron core type.

It is a further object of the present invention to provide an improved combustion powered tool having a suspension which is mounted to the tool to "float" relative to the combustion chamber and thus dampen combustion induced vibrations.

It is yet another object of the present invention to provide an improved combustion powered tool having a suspension mechanism for a combustion chamber fan motor which increases the life of the motor.

It is still another object of the present invention to provide an improved combustion powered tool having a suspension mechanism for a combustion chamber fan motor which can accommodate the mounting of a noise suppression capacitor on or near the fan motor.

BRIEF SUMMARY OF THE INVENTION

The above-listed objects are met or exceeded by the present improved combustion powered fastener tool, which features a mechanism for suspending a combustion chamber fan motor that reduces the effects of the reciprocal axial acceleration of the motor, and the resulting oscillation of the motor, during operation of the tool. In the preferred embodiment, the assembly includes a flexible rubber web vulcanized to a motor retaining ring. The web is also vulcanized to a cylinder head mounting bracket so that only the web secures the ring to the bracket. In addition, the bracket is mounted via threaded fasteners and bushings to the cylinder head so that it will "float" relative to the movement of the combustion chamber. To this end, the bracket features resilient standoffs located at the cylinder head mounting points which provide progressive dampening. As the motor changes position, dampening increases. As such, the present motor suspension mechanism provides more accurately tuned dampening to iron core fan motors than conventional suspensions. Another feature of the present motor suspension is that it permits the mounting of a noise suppression capacitor on the fan motor.

More specifically, the present invention provides a suspension mechanism for a motor of a combustion chamber fan in a combustion powered hand tool constructed and arranged for driving a driver blade to drive a fastener into a work piece, the tool generating an upward axial acceleration of the motor upon combustion in the chamber, a subsequent reciprocal axial acceleration of the motor when the piston bottoms out on a bumper, at least one of the accelerations causing the motor to oscillate relative to the tool, the suspension mechanism includes a suspending portion configured for providing progressive dampening to the motor upon the generation of the axial accelerations.

In another embodiment, the present invention provides a suspension mechanism for a motor of a combustion chamber fan in a combustion powered hand tool constructed and arranged for driving a driver blade to drive a fastener into a work piece, the suspension mechanism comprising a motor mounting bracket which, upon fastening to a cylinder head of the tool, is configured to be movable relative to the cylinder head.

In yet another embodiment, the present invention provides a suspension mechanism for a motor of a combustion chamber fan in a combustion powered hand tool constructed and arranged for driving a driver blade to drive a fastener into a work piece, the suspension mechanism including a rigid motor retaining ring defining a cup for accepting the motor, the motor having an armature shaft end, said motor retaining ring being configured so that the motor is secured thereto only at the armature shaft end.

In addition, the present invention also provides a combustion powered hand tool constructed and arranged for driving a driver blade to drive a fastener into a work piece. The tool includes a combustion chamber defined in part by a cylinder head, a combustion chamber fan, a motor connected to said fan and a suspension mechanism for the motor configured for regulating the relative axial movement of the motor relative to the cylinder head. The suspension mechanism includes a suspending portion configured for providing progressive dampening to the motor upon the initiation of axial acceleration of the cylinder head.

DETAILED DESCRIPTION OF THE INVENTION

Figure 1:
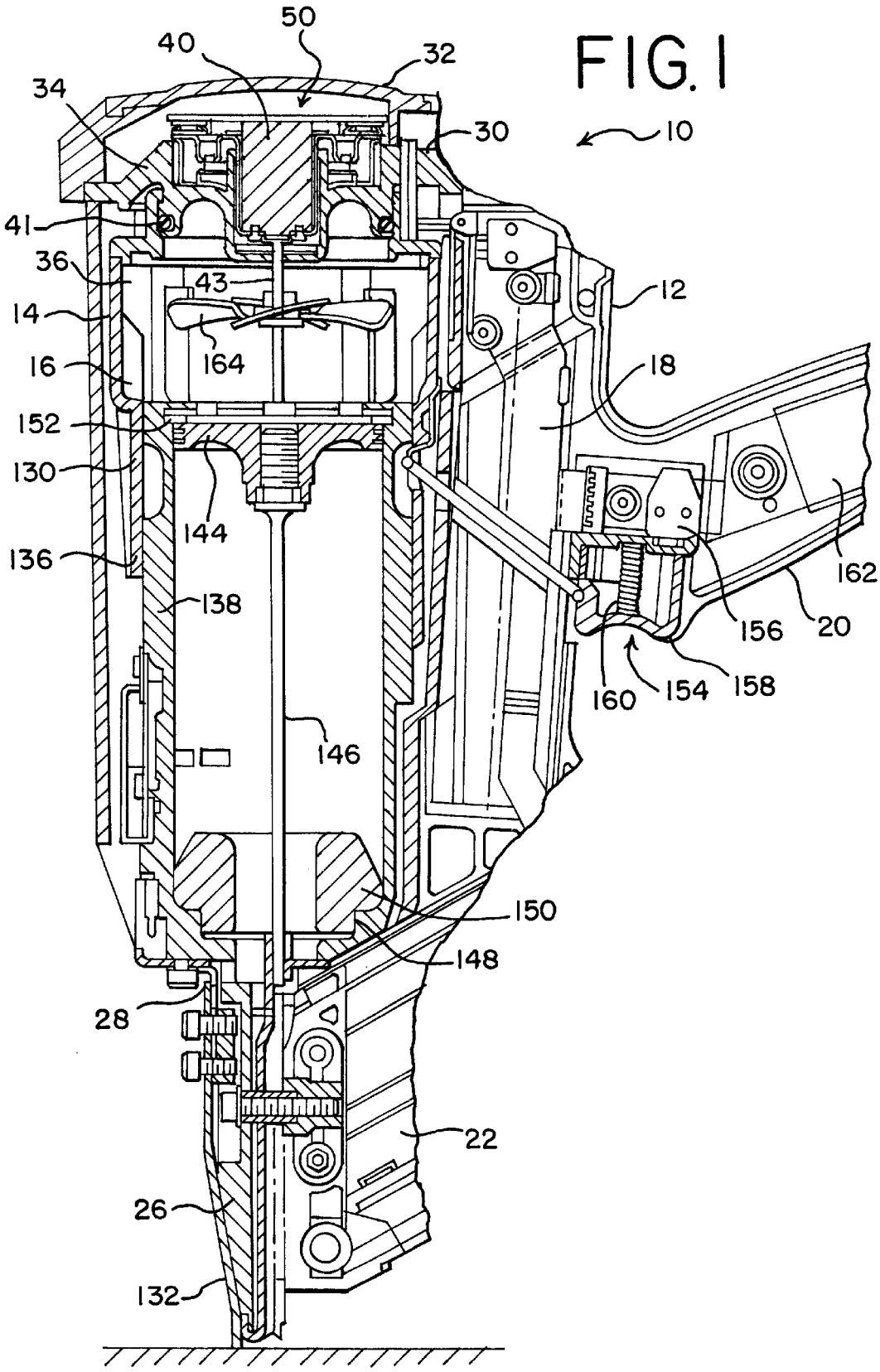
FIG. 1 is a fragmentary side view of a combustion powered fastener tool in accordance with the present invention, the tool being partially cut away and in vertical section for purposes of clarity.

Referring now to FIG. 1, a combustion powered tool of the type suitable for use with the present invention is generally designated 10. The tool 10 has a housing 12 including a main power source chamber 14 dimensioned to enclose a self-contained internal combustion power source 16, a fuel cell chamber 18 generally parallel with and adjacent to the main chamber 14, and a handle portion 20 extending from one side of the fuel cell chamber and opposite the main chamber.

In addition, a fastener magazine 22 is positioned to extend generally parallel to the handle portion 20 from an engagement point with a nosepiece 26 depending from a lower end 28 of the main chamber 14. A battery (not shown) is provided for providing electrical power to the tool 10, and is releasably housed in a compartment (not shown) located on the opposite side of the housing 12 from the fastener magazine 22. Opposite the lower end 28 of the main chamber is an upper end 30. A cap 32 covers the upper end 30 and is releasably fastened to the housing 12 to protect the fan motor and spark plug. As used herein, "lower" and "upper" are used to refer to the tool 10 in its operational orientation as depicted in FIG. 1; however it will be understood that this invention may be used in a variety of orientations depending on the application.

A mechanically linked fuel metering valve (not shown), such as that shown in U.S. Pat. No. 4,483,474 may be used. Alternatively, an electromagnetic, solenoid type fuel metering valve (not shown) or an injector valve of the type described in commonly assigned U.S. Pat. No. 5,263,439 is provided to introduce fuel into the combustion chamber as is known in the art. A pressurized liquid hydrocarbon fuel, such as MAPP, is contained within a fuel cell located in the fuel cell chamber 18 and pressurized by a propellant as is known in the art.

Figure 2:
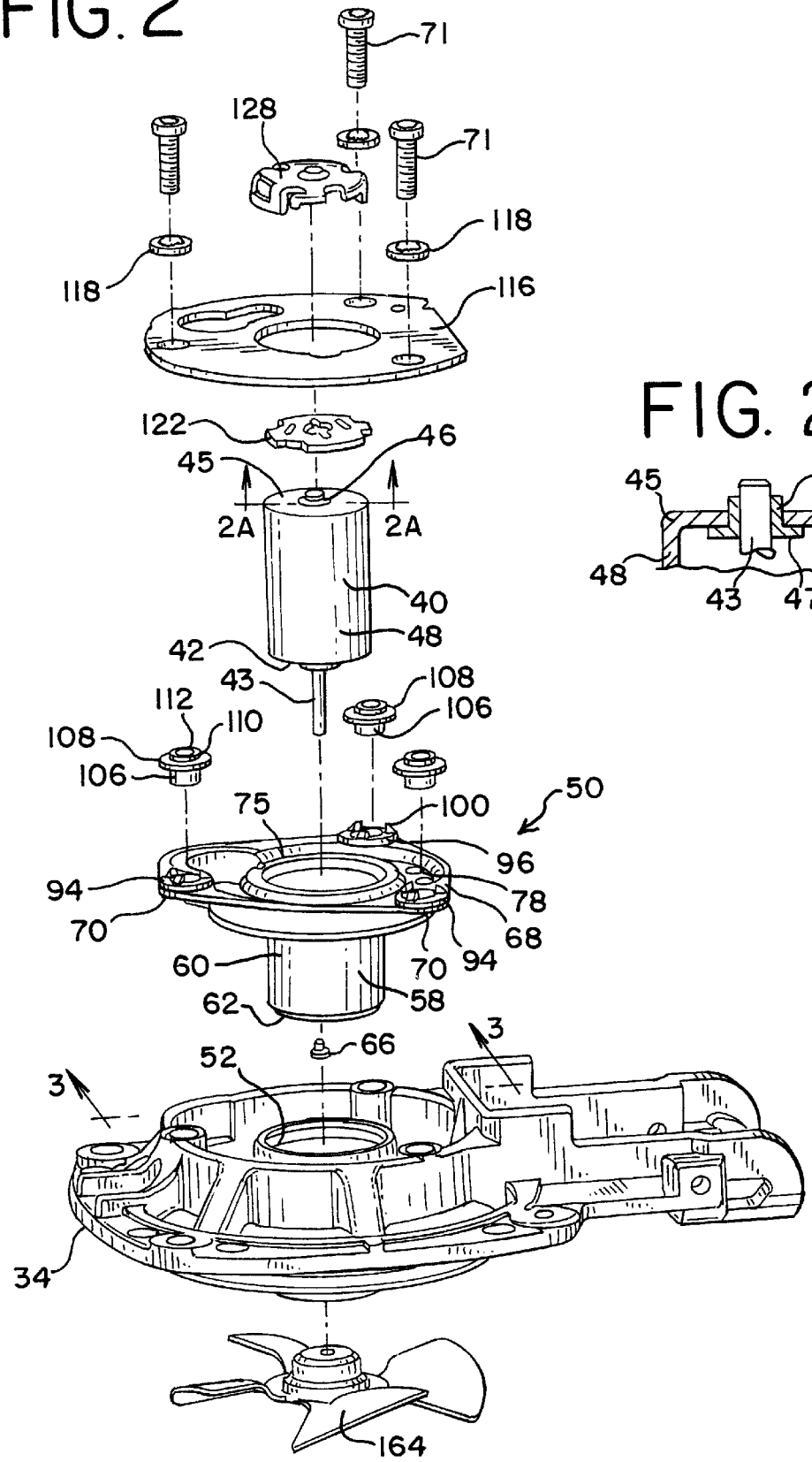
FIG. 2 is an exploded perspective view of the cylinder head of the tool depicted in FIG. 1, with the suspension mechanism and combustion chamber fan motor according to the present invention.
Figure 3:
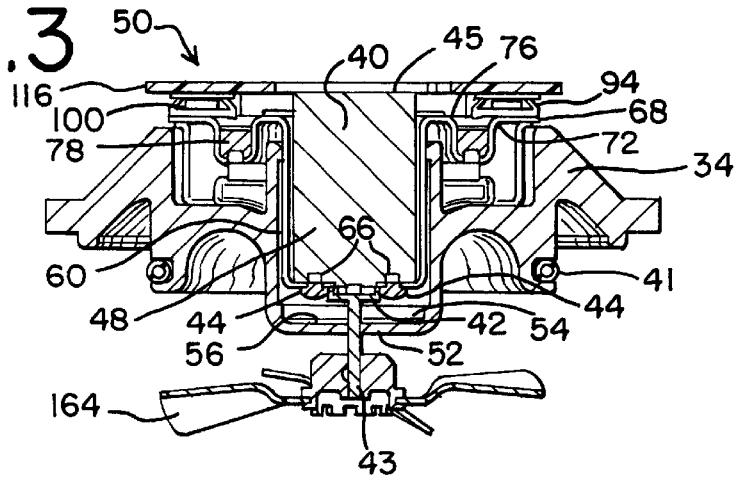
FIG. 3 is a cross-section of the cylinder head and suspension mechanism of the present invention taken along the line 3—3 of FIG. 2 and in the direction generally indicated.

Referring now to FIGS. 1, 2, and 3, a cylinder head 34, disposed at the upper end 30 of the main chamber 14, defines an upper end of a combustion chamber 36, and provides a spark plug port (not shown) for a spark plug 38 (FIG. 4 only), an electric fan motor 40, and a sealing O-ring 41. In the present invention, the fan motor 40 is a conventional iron core motor, also known as permanent magnet, brushed DC motor of the type produced by Nidec Copal of Tokyo, Japan, Canon of Japan, as well as many other known motor manufacturers. The motor 40 has an armature shaft end 42 with an armature (not shown), an armature shaft 43, and at least one mounting aperture 44, which may be threaded depending on the application.

Figure 2A:
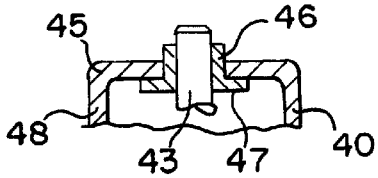
FIG. 2A is a section taken along the line 2A of FIG. 2 and in the direction generally indicated.

Referring to FIGS. 2, 2A and 3, the motor 40 includes a brush end 45 opposite the armature shaft end 42. As is known in the art, the armature shaft 43 (and the armature, not shown) is supported in the motor by bearings. A bearing 46 at the brush end 45, and similarly at the armature shaft end 42, axially supports the armature shaft 43 and the armature. A feature of the present motor 40 is that the bearing 46 has a flange 47 which is located inside a motor housing 48, rather than outside, as in many conventional motors. This disposition of the bearing 46 and the flange 47 has been found to prevent unwanted unseating of conventional bushings after exposure to repeated reciprocal forces of the type generated by combustion tools and described above. Aside from the modifications recited above, a conventional iron core motor is preferably beefed up to better withstand the challenging environment of a combustion tool. For example, the commutator is preferably provided with plastic tabs to prevent it from rotating relative to the armature shaft 43, additional adhesive is applied to the commutator to increase axial and rotational load capacities and the wire ends of the armature windings are wrapped around the insulator additional times to prevent their unwinding.

The fan motor 40 is slidingly suspended by a fan motor suspension mechanism, generally designated 50, within a depending cavity 52 in the center of the cylinder head 34 to allow for some longitudinal movement of the motor. As is best seen in FIG. 3, the motor 40 is preferably retained in the cavity 52 so that an air gap 54 is created between the lower or armature shaft end 42 of the motor (enclosed by a protective cap as will be described below) and a floor 56 of the cavity 52. The function of the air gap 54 is to provide operating dynamic clearance, i.e., to provide clearance for the motor during oscillations occurring in the course of operation.

Figure 6:
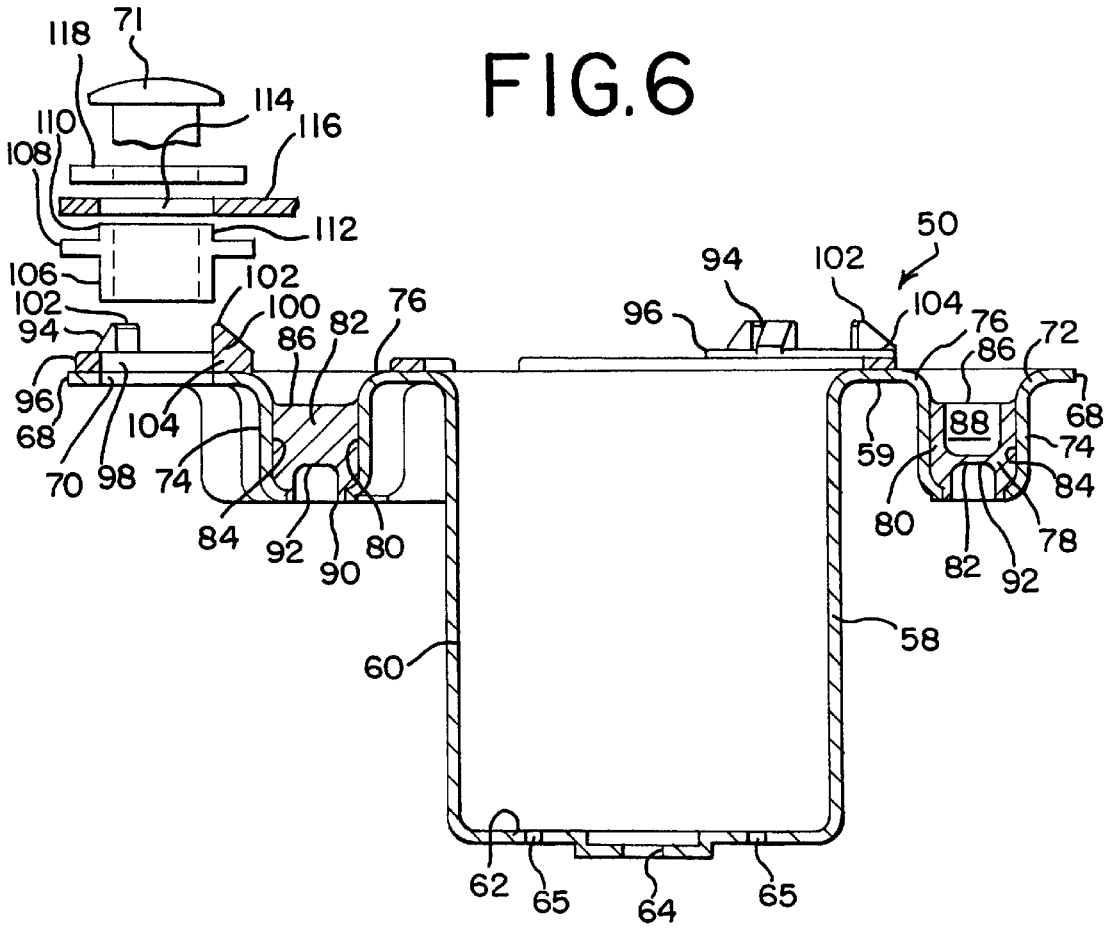
FIG. 6 is a cross-section taken along the line 6—6 of FIG. 4 and in the direction generally indicated.

Referring now to FIGS. 2, 3 and 6, in a preferred embodiment, the mechanism 50 includes a rigid, circular motor retaining cup 58 having an outer annular lip 59, a generally cylindrical sidewall 60 and a floor 62. In the preferred embodiment, the motor retaining cup 58 is made by drawing a flat disk of sheet metal or equivalent material, and is dimensioned to circumscribe and enclose the motor 40, however it can be appreciated that other shapes for the cup 58 may be used in tools having different combustion chamber head shapes. l An advantage of this structure of the cup 58 is that it provides a heat and dirt barrier for protecting the motor 40. Further, the cup 58 provides the attachment point for the motor 40, since the floor 62 is provided with a central armature shaft aperture 64 (FIG. 6.) for accommodating the armature shaft 43, and apertures 65 through which fasteners 66 secure the armature shaft end 42 to the floor 62.

Thus, a feature of the present suspension 50 is that the motor 40 is secured to the cup 58 only at the armature shaft end 42. Yet another feature of the motor retaining cup 58 is that once the motor 40 is secured thereto, it serves as a linear bearing journal for axial movement of the motor relative to the cavity 52 in the cylinder head 34.

The suspension mechanism 50 also includes a mounting bracket 68 which is secured to the cylinder head 34 with a plurality of, and preferably three openings 70 through which are passed threaded fasteners 71. As best seen in FIGS. 3 and 6, the bracket 68 includes an inner radiused shoulder 72 and a depending sidewall 74. The shoulder 72 and the sidewall 74 of the bracket 68 are concentric with, and radially spaced from, a radial lip 76 of the motor retaining cup 58. In the preferred embodiment, the motor retaining cup 58 is provided with a resilient "C"-shaped bumper 75 (FIG. 4) vulcanized or bonded to the outer annular lip 59 of the cup 58. The bumper 75 prevents the motor retaining cup 58 from contacting a circuit board 116 if the tool is dropped.

Between and integrally secured to the depending sidewall 74 and the radial lip 76 is a resilient web 78 having an inner portion 80 secured to the sidewall lip 76, a middle portion 82, and an outer portion 84 secured to the sidewall 74 (best seen in FIG. 6). In the preferred embodiment, the web 78 is a neoprene rubber with a durometer of 25–30 hardness which is vulcanized both to the cup 58 and the bracket 68. However, it is contemplated that other materials and bonding methods as are known in the art will provide the necessary adhesion and flexibility properties similar to those of rubber.

Figure 4:
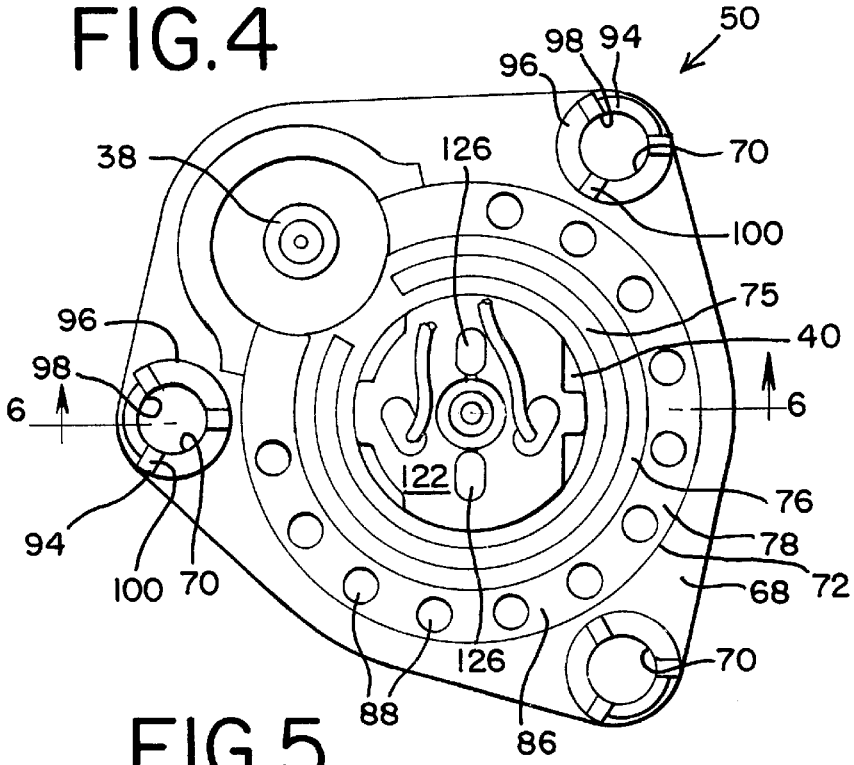
FIG. 4 is an overhead plan view of the present suspension mechanism, with portions omitted for clarity.

As best shown in FIG. 6, the web 78 is secured to the sidewall 74 and the lip 76 such that an upper surface 86 of the web forms an annular dish-like groove or recessed area. It will be seen that the web 78 is the only structure provided for securing the head mounting bracket 68 to the motor retaining cup 58. Also, in the preferred embodiment, the upper surface 86 preferably has a plurality of equidistantly spaced, descending bores 88 extending at least partially through the middle portion 82. In the preferred embodiment, the bores 88 are blind, in that they do not extend entirely through the middle portion 82. This construction is preferred as a manufacturing technique to prevent rubber flashings created by molding throughbores from becoming detached from the web 78 and falling into the engine. A lower surface 90 of the web 78 has an annular groove 92 which is configured such that the groove does not communicate with the bores 88. As shown in FIG. 4, the web 78 and a part of the mounting bracket 68 are interrupted, and do not form complete circles, to allow for a space for installing the spark plug 38.

The web 78 provides a shock absorbing and isolating system to minimize the operational dynamics of the main chamber 14 caused by the combustion on the motor and also to protect the motor from axial acceleration and large oscillations. Although the preferred embodiment includes the bores 88 in the upper surface 86 and the annular groove 92 in the lower surface 90, it is contemplated that the bores and the groove could be in either surface 86, 90, and that the depth of the groove 92 may vary. The depth and orientation of the bores 88 may vary with the application. For example, a second set of bores may also be provided to the web 78 so that they open toward the lower surface 90. Also, the depth of the groove 92 may vary with the application. Further, it is contemplated that several other patterns or other durometers for the rubber for the web 78 would provide similar shock absorbing characteristics. Therefore, the bores 88, and the groove 92 do not necessarily need to be present, and if present, do not necessarily need to be round, nor the grooves or recessed areas 86, 92 annular, nor do all of the bores need to be in the upper surface 86 characterized by rounded corners to prevent tearing. It is contemplated that one of ordinary skill in the art will be able to vary the number, spacing, disposition and/or configuration of the bores 88 and/or the groove 92 to suit a particular application.

Figure 5:
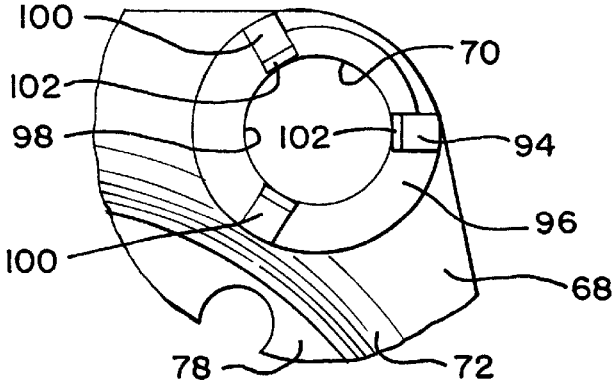
FIG. 5 is an enlarged fragmentary view of the mechanism depicted in FIG. 4.

Referring now to FIGS. 4–6, an important feature of the present suspension mechanism 50 is that it provides progressive dampening to the motor 40 upon the generation of impact forces by combustion in the tool 10. In the present application, "progressive dampening" means that the suspension mechanism 50 provides increased energy absorption as the motor 40 moves axially relative to the cylinder head 34. This progressive dampening reduces operationally-induced acceleration and oscillation of the motor 40 and allows the use of more conventional motors to drive the fan.

One aspect of the present suspension mechanism 50 which provides this advantage is that the mounting bracket 68 is partially de-coupled relative to the cylinder head 34. Rather than being rigidly secured to the cylinder head 34, the mounting bracket 68 is fastened to the cylinder head with a plurality (preferably three) of the threaded fasteners 71 and plurality of bushings described below, but is retained in an axially spaced relationship relative to the cylinder head by a like plurality of resilient spacer members 94 at each attachment point. Each of the spacer members 94 has a base 96 which, in the preferred embodiment is generally circular, however other shapes are contemplated. A central aperture 98 is provided for accommodating the bushing and the fastener 71. In addition, each spacer member 94 has a plurality, and preferably three, peripherally spaced rubber or otherwise resilient standoffs 100 projecting generally axially from the base 96.

When viewed from the side, the rubber standoffs 100 are tapered and form a generally pointed upper end or tip 102 as they extend from a lower end 104 adjoining the base 96. It is this tapered or triangular configuration which provides the progressive dampening. It is also contemplated that the number and precise configuration of the standoffs 100 may vary to suit the application. It should be noted that the spacer members 94 are preferably made of the same rubber-like material which forms the resilient web 78, and are preferably vulcanized to the mounting bracket 68 when the web 78 is formed.

Referring now to FIGS. 2 and 6, the upward travel of the mounting bracket 68 and the spacer members 94 is restrained by a rigid mounting bushing 106 associated with each spacer member. Each of the mounting bushings 106 is configured for matingly engaging the resilient spacer member 94 and has a radially projecting lip 108 for providing a stop to axial movement of the head mounting bracket 68. The lip 108 is provided with a diameter sufficient to engage the standoffs 100. In addition, the bushings 106 engage the cylinder head 34 a(their lower ends, and are provided with a sufficient axial length to accommodate vertical travel of the mounting bracket 68 during operation. At their upper ends 110, the bushings 106 have a nipple 112 dimensioned to matingly engage a corresponding opening 114 in a circuit board 116 (FIG. 6). At each attachment point, once the fastener 71, with the assistance of a lockwasher 118, secures the circuit board 116 and the bushing 106 to the cylinder head 34, the mounting bracket 68, and the suspension 50, actually "float", or are movable independently of, and relative to the cylinder head.

Due to the construction of the standoffs 100, when operational forces cause the suspension 50 to move upward relative to the cylinder head 34, the standoffs 100 compress, and their tapered configuration provides progressively more dampening with increased axial movement of the mounting bracket 68. Accordingly, with more axial travel of the mounting bracket 68, there will be more energy absorbed by the resilient spacer members 94 to decelerate the motor 40. The dampening is limited by the radial lip 108 and the circuit board 116. If necessary, additional energy is absorbed by the resilient web 78, which allows the motor retaining cup 58 to move relative to the mounting bracket 68.

Figure 7:
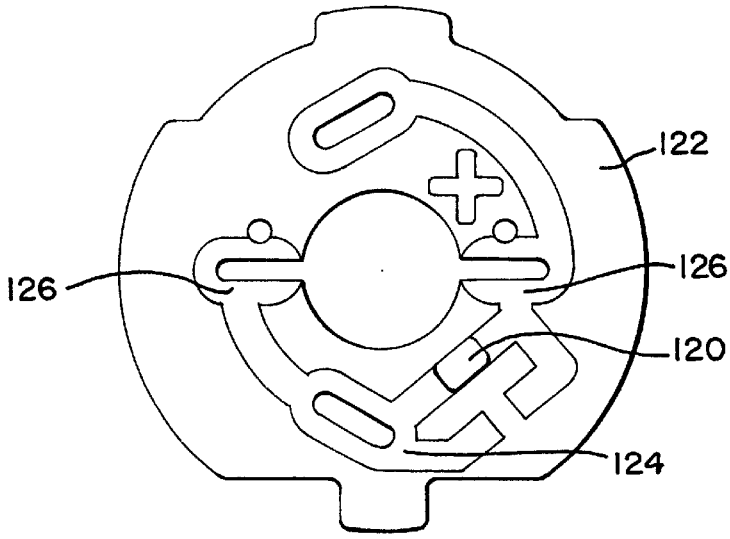
FIG. 7 is an overhead plan view of a circuit board configured for mounting to the present combustion fan motor.

Referring now to FIGS. 2 and 7, another feature of the present tool 10 is that the increased effectiveness of the suspension mechanism 50 allows for the mounting of a noise suppression capacitor 120 directly upon the motor 40. As indicated above, noise suppression capacitors are known for the purpose of reducing voltage spikes and transients. In conventional combustion tools of the type sold under the IMPULSE® brand, the relatively heavy duty ironless core motors did not generate voltage spikes to the extent where a noise suppression capacitor was needed. However, the present tool 10 employs the typically lighter duty iron core motors 40 with which such suppression is advisable, especially to protect the electronic control unit (ECU) which generates the signal for the spark plug 38. By the same token, these types of capacitors cannot normally survive the significant "g" forces generated in a combustion tool. Thus, the present suspension mechanism 50 provides another benefit in that the capacitor 120 can be mounted directly on the motor 40, for increased suppressive qualities.

More specifically, the capacitor 120, which is preferably of the 1 uf size, although other sizes are contemplated depending on the application, is connected to a circuit board 122 having a conventional noise suppression circuit 124, as is known in the art. The circuit board 122 and the capacitor 120 are mounted adjacent the brush end 45 of the motor 40. To withstand the impacts experienced by the motor 40, the circuit board 122 is secured by chemical adhesive to the brush end 45 of the motor, in addition to solder points 126. A protective cap 128 covers the circuit board 122 and snapingly engages the edge of circuit board 122.

Referring now to FIG. 1, the generally cylindrical combustion chamber 36 opens and closes by sliding motion valve member 130 which is moved within the main chamber 14 by a workpiece contacting element 132 on the nosepiece 26 using a linkage in a known manner. The valve member 130 serves as a gas control device in the combustion chamber 36, and sidewalls of the combustion chamber are defined by the valve member 130, the upper end of which sealingly engages an O-ring 41 to seal the upper end of the combustion chamber. A lower portion 136 of the valve member 130 circumscribes a generally cylindrical cylinder body or cylinder 138. An upper end of the cylinder body 138 is provided with an exterior O-ring (not shown) which engages a corresponding portion of the valve member 130 to seal a lower end of the combustion chamber 36.

Within the cylinder body 138 is a reciprocally disposed piston 144 to which is attached a rigid, elongate driver blade 146 used to drive fasteners (not shown), suitably positioned in the nosepiece 26, into a workpiece (not shown). A lower end of the cylinder body defines a seat 148 for a bumper 150 which defines the lower limit of travel of the piston 144. At the opposite end of the cylinder body 138, a piston stop retaining ring 152 is affixed to limit the upward travel of the piston 144.

Located in the handle portion 20 of the housing 12 are the controls for operating the tool 10. A trigger switch assembly 154 includes a trigger switch 156, a trigger 158 and a biased trigger return member 160. The ECU 162 under the control of the trigger switch 156 activates the spark plug 38.

As the trigger 158 is pulled, a signal is generated from the ECU 160 to cause a discharge at the spark gap of the spark plug 38, which ignites the fuel which has been injected into the combustion chamber 36 and vaporized or fragmented by a fan 164. The fan 164 is driven by the armature shaft 43, and is located within the combustion chamber 36 to enhance the combustion process and to facilitate cooling and scavenging. The fan motor 40 is preferably controlled by a head switch and/or the trigger switch 156, as disclosed in more detail in the prior patents incorporated by reference.

The ignition forces the piston 144 and the driver blade 146 down the cylinder body 138, until the driver blade contacts a fastener and drives it into the substrate as is well known in the art. The piston then returns to its original, or "ready" position through differential gas pressures within the cylinder, which are maintained in part by the sealed condition of the combustion chamber 36.

The fan motor 40 experiences two primary accelerations during this cycle. First, when the ignition of combustible gases in the chamber 36 forces the piston 144 downwardly toward the workpiece, and preferably a fastener into the workpiece, the tool 10 experiences an opposing upward force, or a recoil force, in the opposite direction. The fan motor 40, which is suspended by the mechanism 50 in the tool, is accelerated upwardly in the direction of the recoil of the tool by a force transmitted through the suspension mechanism. Further, the armature shaft 43 is accelerated in the same direction by having constrained movement relative to the motor within limits of axial play. Then, in less than approximately 10 milliseconds, the piston 144 bottoms-out in the cylinder 138 against the bumper 150. This action changes the acceleration of the tool 10 towards the workpiece. Therefore, the motor and shaft are now accelerated in this new, opposite direction.

These reciprocal accelerations are repeatable and the suspension mechanism 50 must be tuned so that the motor does not oscillate excessively with respect to the tool and either bottom out or top out as discussed earlier. By "tuned" it is meant that the resilience of the suspension mechanism is adjusted to prevent a particular motor from excessive oscillation within predetermined, application-specific limits, depending on the combustion-induced force generated by the particular power source 16. The present tuned suspension mechanism 50 anticipates the two opposite accelerations separated by a predetermined fairly repeatable time and resiliently constrains the motor within the bounds of the cap and the floor of the cavity to minimize the acceleration force of "g's" witnessed by the motor.

Figure 8:
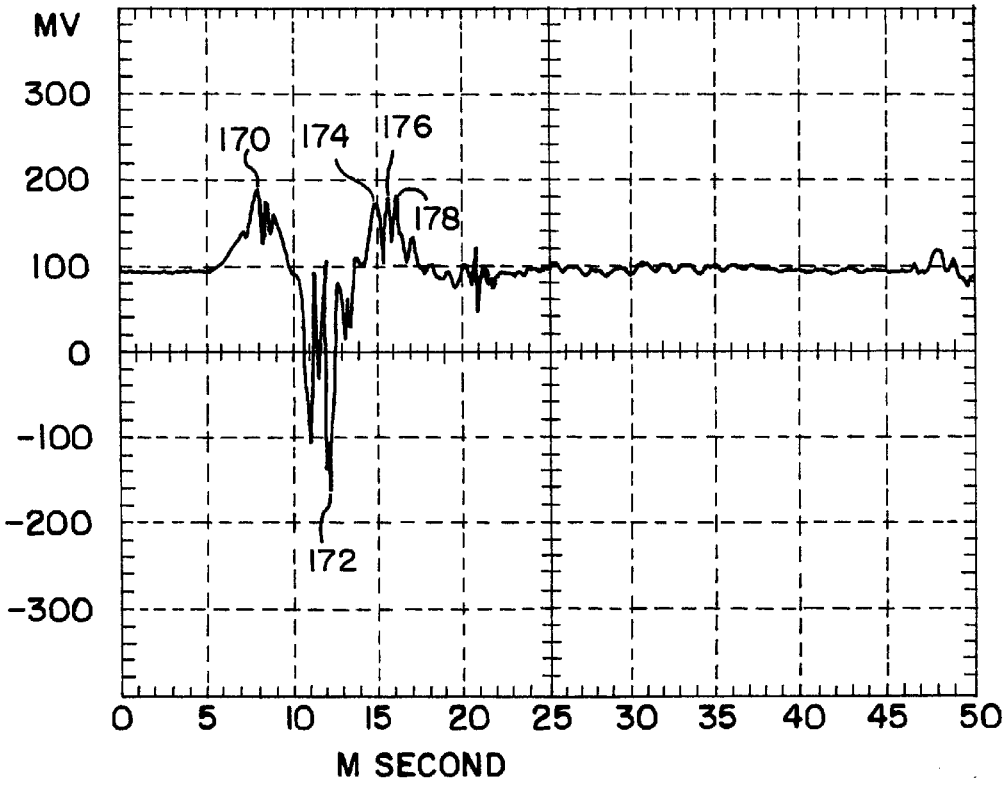
FIG. 8 is a graph showing the operationally-induced acceleration and oscillation of a conventionally-suspended combustion chamber iron core fan motor in a combustion powered hand tool. The X-axis represents time in milliseconds and the Y-axis represents accelerations in g's measured by an accelerometer.
Figure 9:
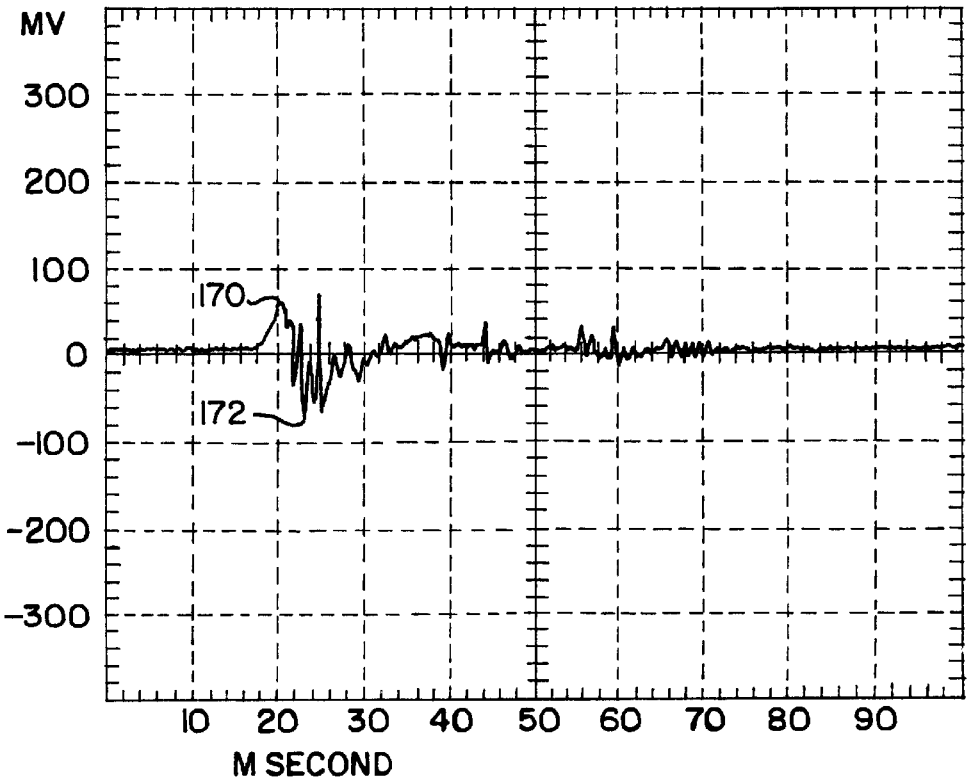
FIG. 9 is a graph of the type in FIG. 8 showing the performance of an iron core fan motor in a combustion powered hand tool equipped with the improved motor suspension of the present invention.

FIGS. 8 and 9 show the acceleration and oscillation experienced by the motor during operation of the tool. The results shown in FIG. 8 are from a tool having a suspension incorporating the resilient web 78 disposed between the cup 58 and the bracket 68, and incorporating an iron core motor 40, which is lighter than the motor for which the suspension was designed. As shown, at about 4 milliseconds after ignition (which occurs at about the 5 millisecond point on the graph), shown at 170, 5 the motor experienced an acceleration force of about or 40 g from the acceleration of the tool due to the recoil force which was immediately transmitted to the motor through the suspension mechanism. At about 9 milliseconds after ignition, shown at 172, the motor experienced an acceleration in the opposite direction of about 135 g following when the piston 144 bottomed-out in the cylinder 138 which was again transmitted to the motor. Thereafter, the motor experienced an oscillation of approximately two additional accelerations greater, labeled as 174 (40 g's) and 176 (25 g's) caused by its lack of tuning of the suspension mechanism. Note that this suspension did not have the present "floating" mounting bracket 68 and the standoffs 100.

FIG. 9 shows the acceleration and oscillation experienced by the motor 40 in a tool 10 equipped with the present improved fan motor suspension mechanism 50. After ignition, the first acceleration 170 of the motor 40 was about 30 g and the reciprocal acceleration 172 was only about 35 g. Thereafter, the motor 40 experienced no additional accelerations above 30 g's. The "floating" progressive dampening provided by the present suspension mechanism 50 causes less immediately transmitted acceleration, while also not allowing excessive amplitude of oscillation so there is no bottoming out or topping out.

The result of the present invention is that the improved fan motor suspension mechanism 50 not only decreases acceleration of the motor 40, but also decreases the overall travel or displacement of the motor and the amount of oscillation of the motor. As shown in FIGS. 8 and 9, due to proper tuning, the improved motor suspension mechanism 50 decreases acceleration and also dampens oscillation and dynamically operates without detrimental contact within the positive constraints of the tool 10 (bottoming or topping out). A major benefit of this discovery is that the motor 40 may be of the inexpensive, lightweight iron core type and may still accommodate the severe acceleration forces generated by the tool 10.

While a particular embodiment of the combustion tool suspension for iron core fan motor of the invention has been shown and described, it will be appreciated by those skilled in the art that changes and modifications may be made thereto without departing from the invention in its broader aspects and as set forth in the following claims.

What is claimed is:

1. A suspension mechanism for a motor of a combustion chamber fan in a combustion powered hand tool constructed and arranged for driving a driver blade to drive a fastener into a work piece, the tool having a cylinder head and generating an upward axial acceleration of the motor upon a combustion in the chamber, a subsequent reciprocal axial acceleration of the motor when a piston connected to the driver blade bottoms out on a bumper, at least one of the accelerations causing the motor to oscillate relative to the tool, said suspension mechanism comprising:

suspending means configured for providing progressive dampening to the motor upon the generation of said axial accelerations; and said suspending means is configured for providing at least one stop defining an amount of axial travel of the motor relative to the cylinder head induced by said axial accelerations, and wherein said progressive dampening increases as the axial travel of the motor increases relative to the cylinder head and toward said at least one stop.

2. The suspension mechanism of claim 1 wherein said means for suspending the motor includes a head mounting bracket vertically slidably engaged upon said at least one stop and resiliently secured to the cylinder head of the combustion chamber.

3. The suspension mechanism of claim 2 further including a plurality of attachment points for attaching said bracket to the cylinder head, each said attachment point including a corresponding one of said at least one stop and being provided with at least one resilient spacer member.

4. The suspension mechanism of claim 3 wherein said at least one resilient spacer member is configured for providing progressive dampening.

5. The suspension mechanism of claim 4 wherein said at least one resilient spacer member has a plurality of spaced standoffs for providing said progressive dampening.

6. The suspension mechanism of claim 5 wherein each said standoff has an upper end and a lower end, and is tapered from said lower end to said upper end.

7. The suspension mechanism of claim 6 wherein there are three standoffs for each mounting point.

8. The suspension mechanism of claim 4 further including a rigid mounting bushing configured for engaging said resilient spacer member and for providing said at least one stop to axial movement of said head mounting bracket.

9. The suspension mechanism of claim 8 wherein said resilient spacer member includes a plurality of tapered standoffs, and said mounting bushing includes a radially projecting lip for engaging said standoffs.

10. The suspension mechanism of claim 1 wherein said means for suspending the motor includes a rigid motor retaining cup defining a space for accepting the motor, a head mounting bracket radially spaced from the retaining cup and configured for attachment to a cylinder head of the combustion chamber, a flexible web disposed between said retaining cup and said mounting bracket and a plurality of attachment points for attaching said mounting bracket to the cylinder head, each said attachment point being provided with said at least one stop and a resilient spacer member configured for providing said progressive dampening.

11. The suspension mechanism of claim 10 wherein said at least one resilient spacer member has a plurality of spaced standoffs for providing said progressive dampening.

12. The suspension mechanism of claim 11 wherein each said standoff has an upper end and a lower end, and is tapered from said lower end to said upper end.

13. The suspension mechanism of claim 1 wherein said dampening is nonlinear.

14. The suspension mechanism of claim 1 wherein said at least one stop is defined by a mounting bushing.

15. The suspension mechanism of claim 1 wherein said at least one stop is defined by a mounting bushing lip matingly engageable with a spacer member.

16. A suspension mechanism for a combustion chamber fan in a combustion powered hand tool constructed and arranged for driving a driver blade to drive a fastener into a work piece, the tool having a cylinder head and generating an upward axial acceleration of the fan upon a combustion in the chamber, a subsequent reciprocal axial acceleration of the fan when a piston connected to the driver blade bottoms out on a bumper, at least one of the accelerations causing the fan to oscillate relative to the tool, said suspension mechanism comprising:

a mounting bracket having a plurality of attachment points configured for fastening said bracket to the cylinder head of the tool, such that, upon fastening said bracket is movable relative to the cylinder head;

each said attachment point includes a rigid mounting bushing configured for providing a stop to axial movement of said mounting bracket relative to the cylinder head, and at least one resilient spacer member being disposed upon said bracket, said at least one resilient spacer member being configured for providing progressive dampening to said bracket as said bracket moves axially relative to the cylinder head against said stop.

17. The suspension mechanism of claim 16 wherein said resilient spacer circumscribes said bushing.

18. The suspension mechanism of claim 16 wherein said resilient spacer has at least one standoff having an upper end and a lower end, and is tapered from said lower end to said upper end.

19. The suspension mechanism of claim 16 further including a flexible web secured between said mounting bracket and an outer annular lip of a motor retaining cup.

20. A suspension mechanism for a combustion chamber fan in a combustion powered hand tool constructed and arranged for driving a driver blade to drive a fastener into a work piece, the tool having a cylinder head and generating an upward axial acceleration of the fan upon a combustion in the chamber, a subsequent reciprocal axial acceleration when a piston connected to the driver blade bottoms out on a bumper, said suspension mechanism comprising:

suspending means configured for providing progressive dampening to the fan upon the generation of said axial accelerations; and said suspending means is configured for providing a bracket and at least one stop defining an amount of axial travel of the bracket relative to the cylinder head induced by said axial accelerations, and wherein said progressive dampening increases as the axial travel of the bracket increases relative to the cylinder head.

21. A suspension mechanism for a motor of a combustion chamber fan in a combustion powered hand tool constructed and arranged for driving a driver blade to drive a fastener into a work piece, the tool having a cylinder head and generating an upward axial acceleration of the motor upon a combustion in the chamber, a subsequent reciprocal axial acceleration of the motor when a piston connected to the driver blade bottoms out on a bumper, at least one of the accelerations causing the motor to oscillate relative to the tool, said suspension mechanism comprising:

suspending means configured for providing progressive dampening to the motor upon the generations; and said suspending means having at least one stop defining an amount of axial travel of the motor relative to the cylinder head induced by said axial accelerations, and wherein said progressive dampening increases as the axial travel of the motor increases relative to the cylinder head and toward said at least one stop.

* * * * *